US005243154A

United States Patent [19]

Tomisawa et al.

[11] Patent Number: 5,243,154

[45] Date of Patent: Sep. 7, 1993

[54] APPARATUS FOR CONTROLLING A HYDRAULIC ELEVATOR

[75] Inventors: Masao Tomisawa, Amagasaki; Takehiko Kubota, Inazawa, both of Japan

[73] Assignee: Mitsubishi Denki Kabushiki Kaisha, Tokyo, Japan

[21] Appl. No.: 775,555

[22] Filed: Oct. 15, 1991

[30] Foreign Application Priority Data

Oct. 16, 1990 [JP] Japan ..... 2-275229

[51] Int. Cl.[5] ..... B66B 1/04

[52] U.S. Cl. ..... 187/111; 187/110; 187/29.2

[58] Field of Search ..... 187/110, 111, 112, 115, 187/116, 120, 29.2

[56] References Cited

U.S. PATENT DOCUMENTS

| | | | |
|---|---|---|---|
| 3,977,497 | 8/1976 | McMurray | 187/17 |
| 4,593,792 | 6/1986 | Yamamoto | 187/111 |
| 4,775,031 | 10/1988 | Nakamura et al. | 187/111 |
| 4,967,128 | 10/1990 | Sawai et al. | 318/609 |
| 5,099,957 | 3/1992 | Eriksson | 187/111 |
| 5,131,507 | 7/1992 | Watanabe | 187/110 |

FOREIGN PATENT DOCUMENTS

| | | | |
|---|---|---|---|
| 0064311 | 1/1989 | Japan . | |
| 0003873 | 1/1991 | Japan | 187/111 |
| 0067877 | 3/1991 | Japan | 187/111 |
| 0079572 | 4/1991 | Japan | 187/111 |
| 0120178 | 5/1991 | Japan | 187/111 |
| 0192079 | 8/1991 | Japan | 187/111 |
| 0267279 | 11/1991 | Japan | 187/110 |
| 0153170 | 5/1992 | Japan | 187/111 |
| 0153172 | 5/1992 | Japan | 187/111 |
| 0189276 | 7/1992 | Japan | 187/111 |
| 2243229 | 10/1991 | United Kingdom | 187/110 |
| 2243927 | 11/1991 | United Kingdom | 187/111 |

*Primary Examiner*—Steven L. Stephan
*Assistant Examiner*—Thomas M. Dougherty
*Attorney, Agent, or Firm*—Leydig, Voit & Mayer

[57] ABSTRACT

An apparatus for controlling a car of a hydraulic elevator by variable-speed-driving an electric motor directly coupled to a hydraulic pump so as to adjust the rate at which oil is supplied from the hydraulic pump to a hydraulic jack system, the apparatus having a speed controller for variable-speed-driving the electric motor, a first detector for detecting the speed of the car, a second detector for detecting the rotational speed of the electric motor, a third detector for detecting a pressure in the hydraulic jack system, a feedback circuit for returning a control signal for limiting vibration of the car as a feedback signal to the speed controller. The feedback circuit forms the control signal from a differential signal representing the difference between a car speed value converted from the rotational speed of the electric motor detected by the second detector and the car speed detected by the first detector and a pressure signal representing the pressure detected by the third detector.

4 Claims, 6 Drawing Sheets

APPARATUS FOR CONTROLLING A HYDRAULIC ELEVATOR

BACKGROUND OF THE INVENTION

1. Field of the Invention

This invention relates to an apparatus for controlling a hydraulic elevator and, more particularly, to a kind of hydraulic elevator vibration damping control such that the flow rate of pressure oil controlled by variable-speed-driving a rotating machine directly coupled to a hydraulic pump.

2. Description of the Related Art

In conventional hydraulic elevators, the speed of the elevator car is controlled by rotating an electric motor at a constant speed and adjusting with a flow rate control valve the rate at which constant-discharge oil is returned from a hydraulic pump to a tank when the elevator car is lifted up and by controlling falling of the elevator car caused by the weight thereof with the flow rate control valve when the elevator car is lowered. This method entails large energy losses and a large increase in the oil temperature because a surplus amount of oil is circulated during lifting and because the potential energy is consumed by heat development in oil during lowering. Recently, a method, such as the one disclosed in Japanese Patent Publication No.64-311, has been proposed in which an induction motor is controlled by variable-voltage variable-frequency control (hereinafter referred to as VVVF control) to control the discharge from a pump directly coupled to the induction motor in a variable control manner. In this method, only a necessary amount of oil is supplied during lifting and the electric motor is operated for regenerative braking, so that energy losses are reduced and the increase in the oil temperature is very small, thereby realizing a high-efficiency hydraulic elevator system.

FIG. 3 is a diagram of the construction of a controller for a hydraulic elevator using a combination of a plunger and a rope and based on the hydraulic elevator operation principle disclosed in Japanese Patent Publication No.64-311.

Referring to FIG. 3, a cylinder 1 is embedded in a pit of an elevator shaft, pressure oil 2 is charged in the cylinder 1, and a plunger 3 is supported by the pressure oil. A deflector sheave 4 is attached to the top end of the plunger 3. A rope 5 is fixed at its one end to the pit and is wrapped round the deflector sheave 4. An elevator car 6 is connected to the other end of the rope 5. A rail 7 serves to guide the car 6. An electromagnetic changeover valve 8 ordinarily functions as a check valve but can be changed to allow a communication in the reverse direction by energization of an electromagnetic coil. A pipe 8*a* is connected between the cylinder 1 and the electromagnetic changeover valve 8 to supply pressure oil. A hydraulic pump 9 is operated in a reversible manner to supply pressure oil to the electromagnetic changeover valve 8 or receive pressure oil from this valve through a pipe 9*a*. An oil tank 10 in which oil is reservoired is provided and oil is supplied from the oil tank 10 to the hydraulic pump 9 or returned from the hydraulic pump 9 to the oil tank 10 through a pipe 10*a*. A three-phase induction motor 11 drives the hydraulic pump 9 by applying a torque T to the hydraulic pump 9. A velocity generator 12 serves to detect revolutions of the three-phase induction motor 11 and outputs a voltage proportional to the number of revolutions N of the three-phase induction motor 11. A converter 14 converts three-phase AC currents from a three-phase AC power supply 13 into a DC current. A converter 15 supplies regenerated power to the three-phase power source. An inverter 16 receives the DC current from the converter 14 and pulse-width-control this current to generate variable-voltage variable-frequency three-phase currents. A speed controller 18 receives a car 6 speed command 17*a*, a pressure balance command 17*b* and the number of revolutions N of the three-phase induction motor 11 to output a control signal 18*a* to the inverter 16. The pressure balance command 17*b* is issued prior to the car speed command at the time of starting a movement of the car 6 to rotate the three-phase induction motor 11 at a low speed such that the pressures in the pipes 9*a* and 8*a* are equalized while the electromagnetic changeover valve 8 is closed. Variable-voltage variable-frequency control is effected between the three-phase induction motor 11 and the inverter 16 although it is not illustrated, and the three-phase induction motor 11 can output to the hydraulic pump 9 torque T proportional to the control signal 18*a* to the inverter 16.

FIGS. 4 and 5 show examples of patterns of car speed command 17*a*, pressure balance command 17*b* given to the speed controller 18 during lifting and lowering, respectively. The operation of the hydraulic elevator controller shown in FIG. 3 will be described below with respect to the commands shown in FIGS. 4 and 5.

The lifting operation will be described below first with reference to FIG. 4. While the electromagnetic changeover valve 8 is closed and while the three-phase induction motor 11 is stopped, pressure balance command 17*b* such as that shown in FIG. 4 is supplied to the speed controller 18 at a time $t_0$. The speed controller 18 thereby outputs control signal 18*a*. Since as mentioned above the inverter 16 and the three-phase induction motor 11 are VVVF-controlled, the three-phase induction motor 11 outputs torque T in accordance with control signal 18*a* to the hydraulic pump 9, and the three-phase induction motor 11 and the hydraulic pump 9 start rotating to produce a pressure in the pipe 9*a*. At this time, a load torque is produced in the hydraulic pump 9 in accordance with the pressure in the pipe 9*a*. However, the number of revolutions N of the three-phase induction motor 11 is returned to the speed controller 18 and the number of revolutions N of the three-phase induction electric motor 11 is increased in accordance with pressure balance command 17*b*, as shown in FIG. 4.

The pressure in the pipe 9*a* connected to the electromagnetic changeover valve 8 becomes equal to the pressure in the pipe 8*a* at a time $t_1$. Then the electromagnetic changeover valve 8 is opened. At a time $t_2$, car speed command 17*a* is issued as illustrated. During lifting operation, the induction motor 11 is revolution command is expressed as the sum of car speed command 17*a* and pressure balance command 17*b*. The three-phase induction motor 11 and the hydraulic pump 9 therefore rotate at a high speed, and oil in the oil tank 10 flows into the cylinder 1 through the pipes 10*a*, 9*a*, and 8*a* to move the plunger 3 and the deflector sheave 4 upward. Since the rope 5 is wrapped round the deflector sheave 4, the deflector sheave 4 is rotated to move the car 6 to an extent twice as large as the extent to which the plunger 3 is moved. Car speed command 17*a* is successively changed to move the position of the car 6. When the car 6 moves to the desired position, the electromagnetic changeover valve 8 is closed to stop the car 6.

Next, the car lowering operation will be described below with reference to FIG. 5. The operation is the same as the lifting operation with respect to the initial step from rotating the three-phase induction motor 11 in accordance with pressure balance command 17*b* to opening the electromagnet valve 8. However, the polarity of car speed command 17*a* is opposite to that of pressure balance command 17*b* as shown in FIG. 5, so that the number of revolutions of the three-phase induction motor 11 is reduced and the three-phase induction motor 11 starts rotating in the lowering direction at a time $t_3$. Pressure oil 2 in the cylinder 1 is thereby recovered to the oil tank 10 through the pipes 8*a*, 9*a*, and 10*a*, and the car 6 is lowered. At this time, the hydraulic pump 9 receives a load in a direction opposite to the direction of its rotation, and the converter 15 regenerates power to the three-phase power supply 13.

A block diagram such as that shown in FIG. 6 is obtained by adding a speed feedback of the three-phase induction motor 11 to a basic formula expressing a vibrating motion during the operation of the hydraulic elevator shown in FIG. 3, that is, when the electromagnetic changeover valve 8 is open.

A block 19 shown in FIG. 6 within a dotted rectangle corresponding to the speed controller 18 designates a coefficient which represents the relationship between the car speed and pump revolutions. $A_J$ is a sectional area of the plunger 3, and $V_0$ is a theoretical displacement of the hydraulic pump 9 per radian revolution. A block 20 designates a transfer function with respect to a signal representing the difference between the rotating speed of the induction motor 11 designated by the revolution command and the actual rotating speed. Control signal 18*a* is formed by this function. By a power supply system constituted by components 11, 13, 14, 15, and 16, torque T is output from the induction motor 11. A block 21 designates a function constituted by a moment of inertia Jeg of the induction motor 11 and the hydraulic pump 9 and a Laplacean S. Torque T is converted into the rotating speed of the induction motor 11, i.e., the number of revolutions N through this function. A block 22 designates a coefficient for conversion of the speed of the induction motor 11 into the speed of the car 6, which is, of course, reciprocal of coefficient 19. A block 23 designates a coefficient representing a vibration system determined by the elasticity of pressure oil in the cylinder 1, the mass of the plunger 3, the mass of the car 6 and the elasticity of the rope 5, and $\tau_0$ is a time constant of this vibration system. By conversion of this coefficient, a car speed Xc is obtained. A block 24 designates a function for converting the car speed Xc into a pressure $P_1$ of pressure oil 2 in the cylinder 1, the pipes 8*a* and 9*a* and the hydraulic pump 9. The load imposed upon the hydraulic pump 9 is obtained by multiplying pressure $P_1$ by a theoretical displacement 25 of the hydraulic pump 9 per radian revolution. The gain of transfer function 20 is set to a high level in order to rotate the induction motor 11 in response to pressure balance command 17*b* and car speed command 17*a* by prevailing over the load imposed upon the hydraulic pump 9. The variation in the speed of the induction motor 11 in the case of vibration at car speed Xc and time constant $\tau_0$ is therefore very small. That is, no vibration component appears in the result of detection of the rotational speed of the induction motor 11.

However, the coefficient 23 representing a vibration characteristic of the hydraulic mechanical system as shown in FIG. 6 contains no attenuation term. The control system therefore entails a drawback such that if vibration corresponding to a pole of the hydraulic mechanical system (natural frequency: $1/\tau_0$) is caused by a change in speed pattern during traveling operation or a certain shock, it lasts for a long time, so that the passenger has a feeling of uncomfortableness.

SUMMARY OF THE INVENTION

In view of the above-described problems, an object of the present invention is to provide an apparatus for controlling a hydraulic elevator improved in terms of comfort.

In order to achieve the above object, according to the present invention, there is provided an apparatus for controlling a hydraulic elevator in which the speed of an elevator car is controlled by variable-speed-driving of an electric motor directly coupled to a hydraulic pump so as to adjust the rate at which oil is supplied from the hydraulic pump to a hydraulic jack system, the apparatus comprising speed control means for variable-speed-driving the electric motor, first detection means for detecting the speed of the car; second detection means for detecting the rotational speed of the electric motor; third detection means for detecting a pressure in the hydraulic jack system; and feedback means for returning a control signal for limiting vibration of the car as a feedback signal to the speed control means, the feedback means forming the control signal from a differential signal representing the difference between a car speed value converted from the rotational speed of the electric motor detected by the second detection means and the car speed detected by the first detection means and a pressure signal representing the pressure detected by the third detection means.

DESCRIPTION OF THE PREFERRED EMBODIMENT

An embodiment of the present invention will be described below with reference to the accompanying drawings.

Figure 1:
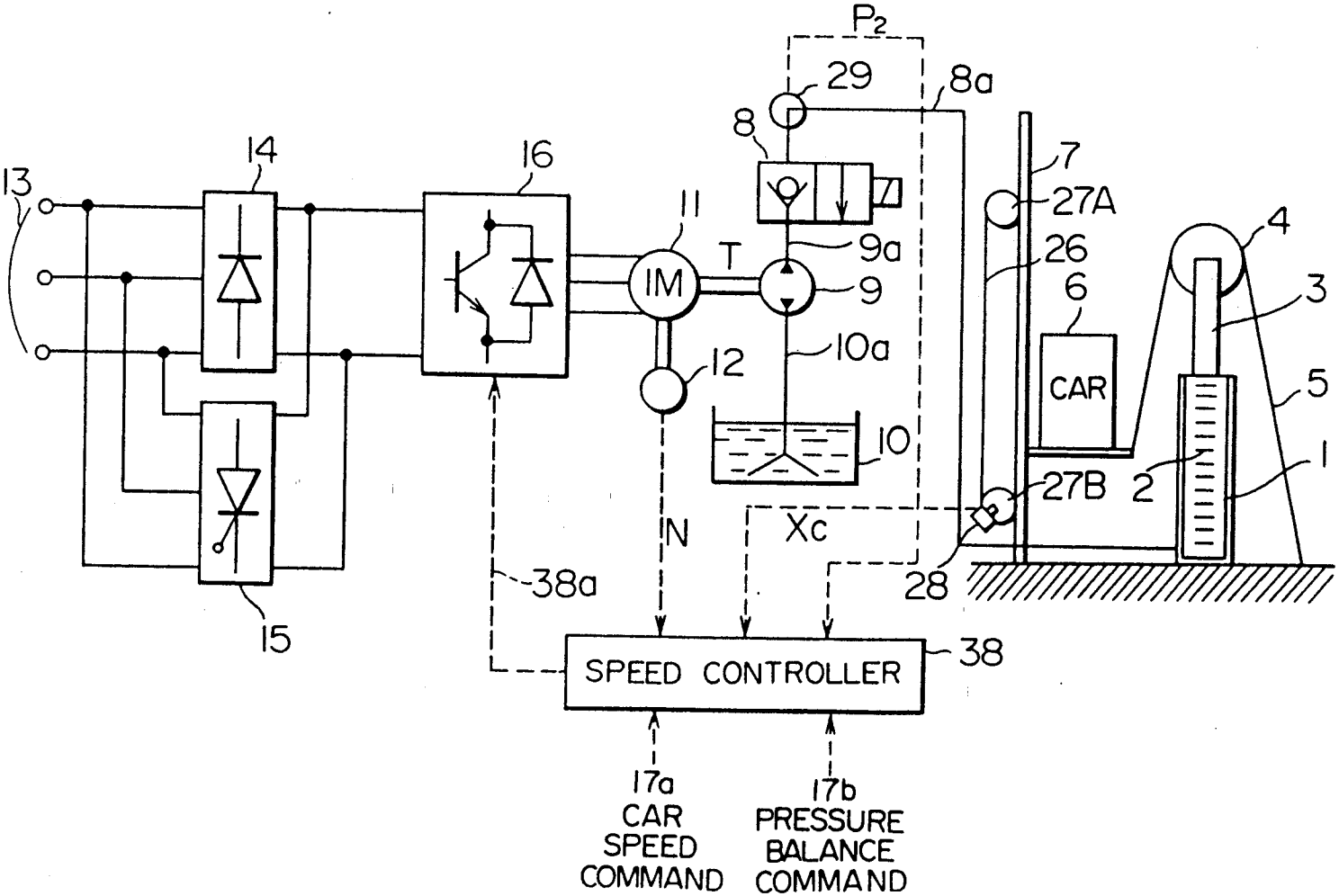
FIG. 1 is a block diagram of a hydraulic elevator controller in accordance with an embodiment of the present invention.
Figure 3:
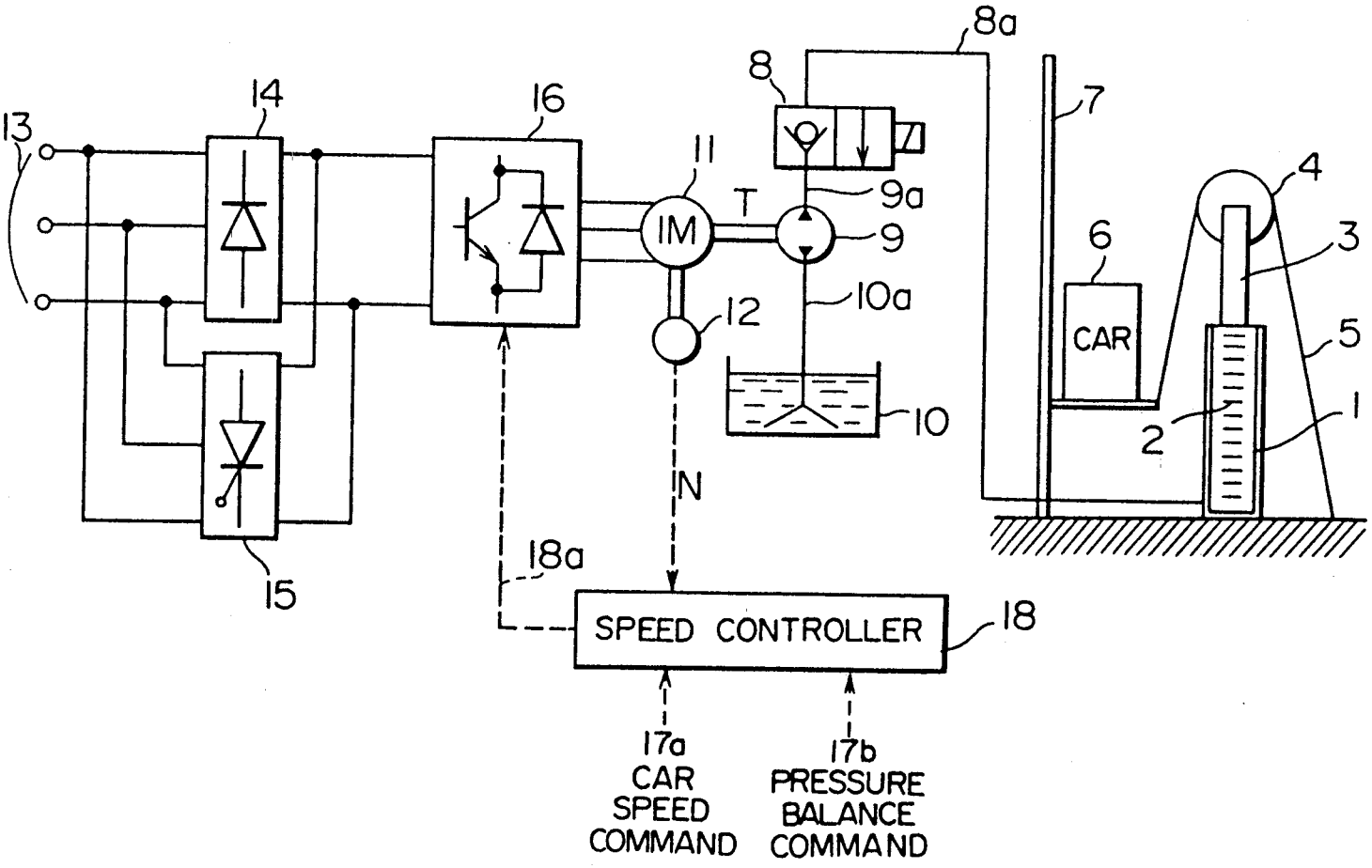
FIG. 3 PRIOR ART
FIG. 3 is a block diagram of the conventional hydraulic elevator controller.
Figure 4:
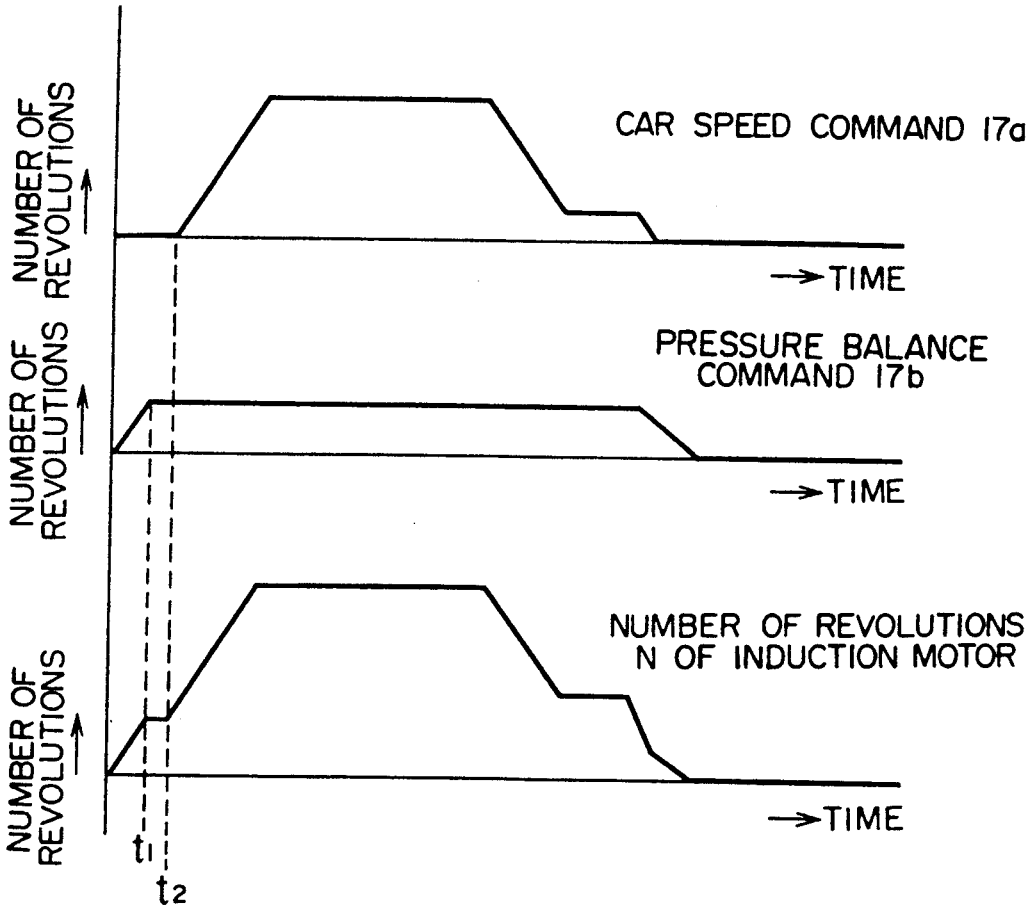
FIG. 4 PRIOR ART
FIGS. 4 and 5 are diagrams of speed command patterns during lifting and lowering of the car of a variable-speed-operation hydraulic elevator.
Figure 5:
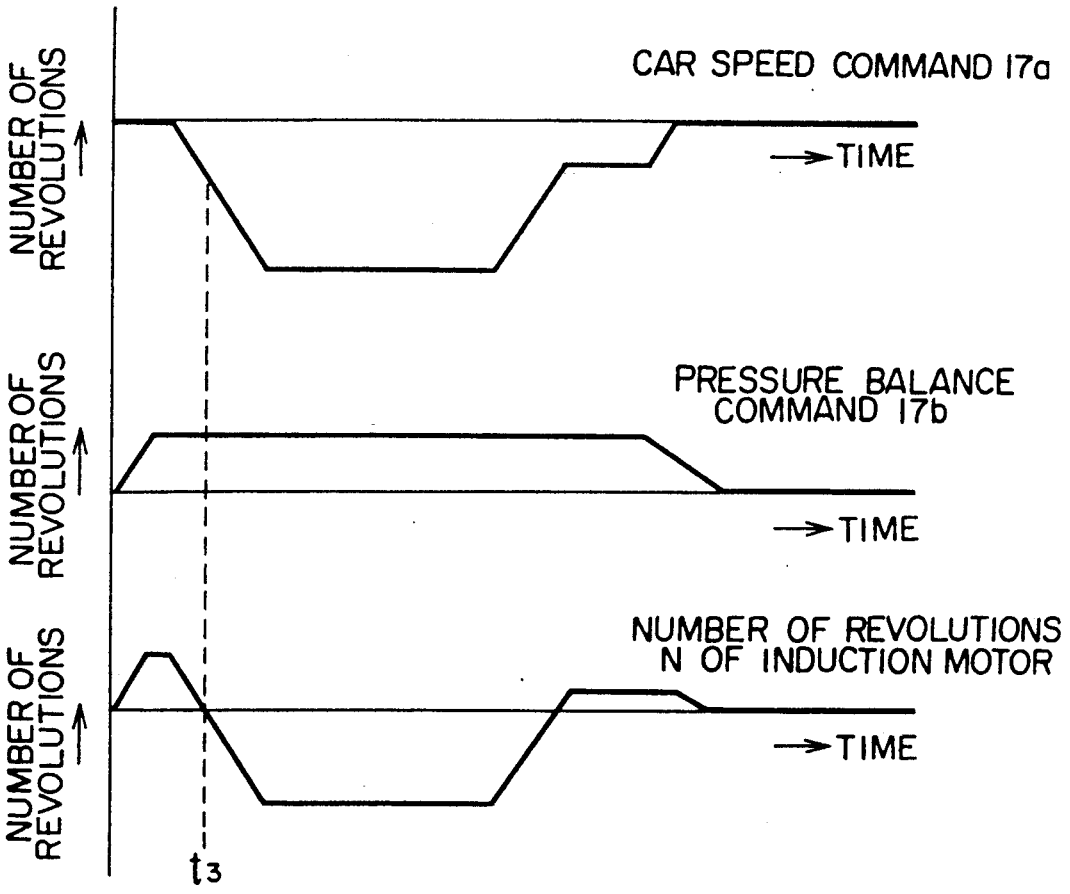
FIG. 5 PRIOR ART

Components or signals 1 to 17*b* of the embodiment of the present invention shown in FIG. 1 are the same as those of the conventional apparatus shown in FIG. 3. In this embodiment, a rope 26 is attached to the car 6 for the purpose of detecting the speed of the car 6, and pulleys 27A and 27B for guiding the rope 26 are attached to upper and lower portions of the rail 7. A speed detector 28 is attached to the pulley 27B and outputs a voltage proportional to speed Xc of the car 6. A pressure detector 29 is provided to detect a pressure $P_2$ in the pipe 8*a* and to output a voltage proportional to pressure $P_2$. A speed controller 38 receives the number of revolutions N of a rotating machine, e.g., three-phase induction motor 11, speed Xc of the car 6, pressure $P_2$ in the pipe 8a, car speed command 17a, and pressure balance command 17b, and outputs a control signal 38a to the inverter 16.

Figure 2:
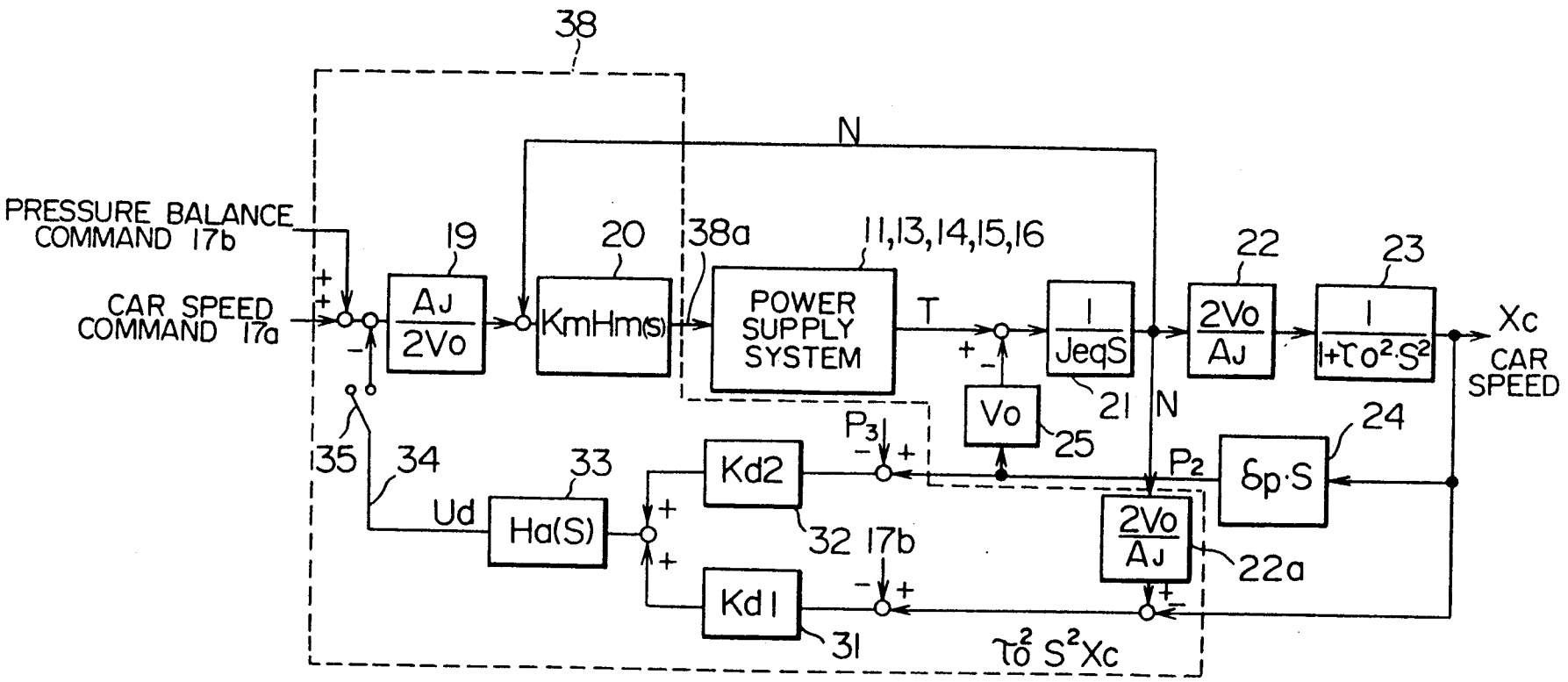
FIG. 2 is a block diagram of the control system of the embodiment.
Figure 6:
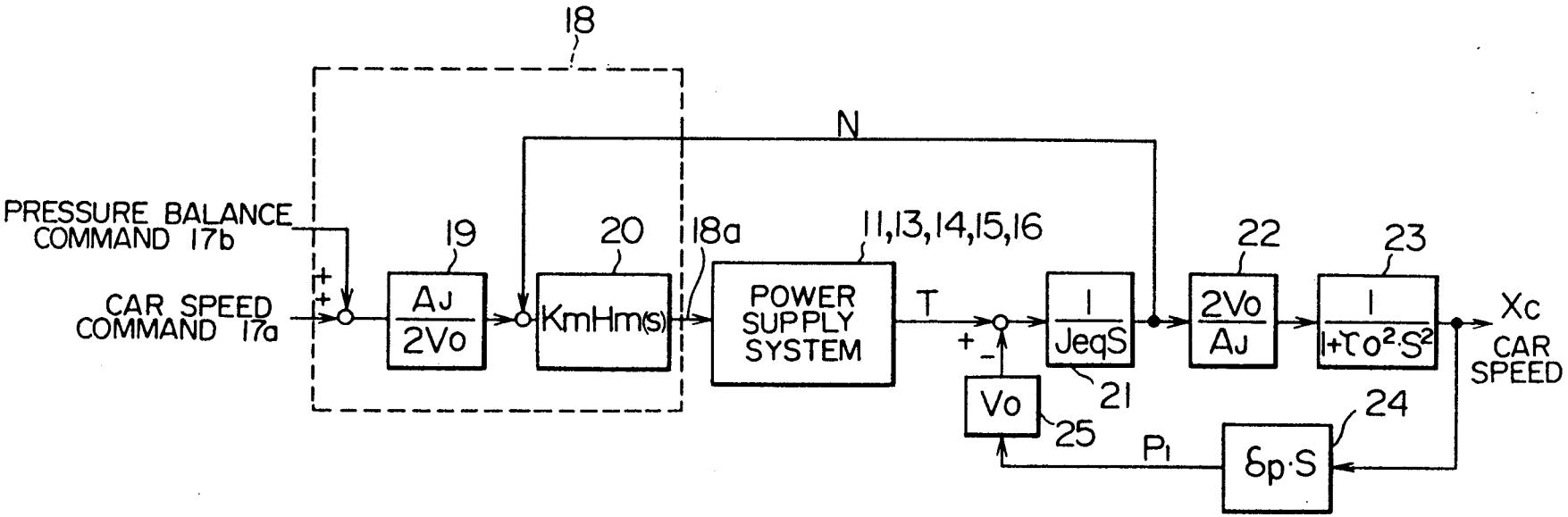
FIG. 6 PRIOR ART
FIG. 6 is a block diagram of the control system of the conventional controller.

FIG. 2 is a block diagram of the content of calculations in the speed controller 38 and transfer characteristics of the hydraulic mechanical system. Blocks 19 to 25 are the same as those of the conventional control system shown in FIG. 6. A block 22a within an area indicated by the dotted line and corresponding to the speed controller 38 designates a coefficient for conversion of the number of revolutions N of the induction motor 11 into the speed of the car 6. A block 31 designates a gain $Kd_1$ for a signal representing a difference defined between the number of revolutions N of the induction motor 11 and the car speed Xc, a block 32 designates a gain $Kd_2$ for pressure $P_2$ in the pipe 8a, and a block 33 designates a compensation factor Ha(S). A number 35 denotes a switch 35 for supplying a control signal Ud as a feedback signal to the speed control system for the induction motor 11.

The number of revolutions N of the induction motor 11 obtained through the function 21 is multiplied by the conversion coefficient 22a in the speed controller 38, and a signal representing the difference between a value thereby calculated and the car speed Xc is obtained. Pressure balance command 17b is subtracted from this differential signal to cut a DC component of this signal. The differential digital is therefore multiplied by gain 31. A pressure $P_3$, read immediately before the time at which the electromagnetic changeover valve 8 is opened after the apparatus has been operated based on pressure balance 17b alone by closing the electromagnetic changeover valve B, is subtracted from pressure $P_2$ in the pipe 8a converted by the function 24 to cut a DC component of pressure $P_2$, and pressure $P_2$ is therefore multiplied by gain 32.

The differential signal of the number of revolutions N of the induction motor 11 multiplied by gain 31 and the car speed Xc is added to pressure $P_2$ in the pipe 8a multiplied by gain 32, and the added signal is changed by compensation factor 33 to obtain control signal Ud. Control signal thus obtained is returned as a feedback signal to the speed control system for the induction motor 11. The compensation factor Hd(S) is determined to cut fluctuations in the DC signal caused by a pressure loss in the pipe 8a and a change in a leakage characteristic of the pump during hydraulic elevator operation and to limit an oscillation of pole $S = i/\tau_0$ (i: imaginary unit) caused by the above-mentioned vibration system 23. If determined by the pole the speed control system for the induction motor 11 is higher than pole $S = i/\tau_0$ of the hydraulic mechanical system, the compensation factor may be selected as $$Hd(S) = \tau_C^2 \cdot S/(1+\tau_C S)^2 \quad (1)$$

where $\tau_C$ is a time constant of the speed control system for the induction motor 11 which is set to a value sufficiently greater than the time constant $\tau_0$ of the hydraulic mechanical system.

The operation of this embodiment will now be described below. The switch 35 is open, when pressure balance command 17b is supplied to the speed controller 38 while the electromagnetic changeover valve 8 is closed and while the three-phase induction motor 11 is stopped. At this time, therefore, the operation of the hydraulic elevator is the same as that in the case of the conventional control apparatus shown in FIG. 3. When the pressure in the pipe 9a connected to the electromagnetic valve 8 becomes substantially equal to the pressure in the pipe 8a, the electromagnetic changeover valve 8 is opened, car speed command 17a is issued and the switch 35 is simultaneously closed to return control signal Ud to the speed control system for the three-phase induction motor 11.

At this time, no shock is caused when the switch 35 is closed, since control signal Ud is generated by the subtraction of pressure balance command 17b immediately before the opening of the electromagnetic changeover valve 8 and pressure $P_3$ at the corresponding time as shown in the block diagram of FIG. 2. That is, DC components are cut by the subtraction of pressure balance command 17b and pressure P3 produced at the corresponding time, so that only AC components (vibration components) are detected. Therefore there is substantially no transient change when the switch 35 is turned on or off, and the pressure can be changed smoothly. Consequently, transient disturbance applied from the speed control system is prevented.

Assuming that the car 6 vibrates by receiving a disturbance when the switch 35 is closed, that is, during traveling of the car 6, control signal Ud obtained by using vibration components while removing DC components is expressed by using the block diagram of FIG. 2 and Hd(S) of the equation (1), as shown below.

$$Ud = \frac{\tau_C^2 S^2}{(1+\tau_C S)^2}(Kd_2\delta_p + Kd_1\tau_0^2 S)Xc \quad (2)$$

Since the pole of the speed control system for the induction motor 11 is very high in comparison with that of the hydraulic mechanical system, the speed of the three-phase induction motor 11 is changed in response to control signal Ud described above. Moreover, because $\tau_C$ is set to a value greater than $\tau_0$ of the hydraulic mechanical system, the first term on the right side of the equation (2) functions as a secondary high-pass filter. That is, of the feedback of control signal Ud expressed by the equation (2), $Kd_2\delta p$ corresponds to application of elasticity while $Kd_1\tau_0^2$ corresponds to application of attenuation with respect to the pole of the hydraulic mechanical system, and the pole of the hydraulic mechanical system can be positioned as desired by selecting the gains $Kd_1$ and $Kd_2$ of the speed control system. This effect is apparent from a theory of the control technology. Further, since the pressure of the hydraulic jack system and the difference between the speeds of the car 6 and the induction motor 11 are detected, $\delta p$ and $\tau_0$ of the equation (2) are automatically changed by the number of passengers in the car 6. Accordingly, the speed control system of this invention is changed according to a change of the pole of the hydraulic mechanical system based on the number of passengers in the car of the hydraulic elevator to maintain the desired effect.

While in the above-described embodiment the equation (1) is used as compensation factor 33, compensation factor in other forms may be used according to the interrelation between the pole of the speed control system for the three-phase induction motor and the pole of the hydraulic mechanical system to obtain the same effect.

The means for driving the hydraulic pump is not limited to the three-phase induction motor. For example, a DC motor or the like can be used to obtain the desired effect if it is capable of variable-speed-controlling the hydraulic pump.

What is claimed is:

1. An apparatus for controlling a hydraulic elevator in which the speed of an elevator car is controlled by driving an electric motor at a variable speed, the electric motor being directly coupled to a hydraulic pump so as to adjust the rate at which oil is supplied from the hydraulic pump to a hydraulic jack system, said apparatus comprising:

speed control means for driving the electric motor at a variable speed;

first detection means for detecting the speed of the car, said first detection means being connected to the speed control means second detection means for detecting the rotational speed of the electric motor, said second detection means being connected to said speed control means and said speed control means generating a differential signal;

third detection means for detecting a pressure in the hydraulic jack system said third detection means being connected to said speed means; and feedback means for generating a control signal to limit vibration of the car and for directing the control signal back to said speed control means, said feedback means forming the control signal from the differential signal generating by said speed control means, the differential signal representing the difference between a car speed value converted from the rotational speed of the electric motor detected by said second detection means and the car speed detection by said first detection means and a pressure signal representing the pressure detected by said third detection means, said feedback means being connected to said speed control means.

2. An apparatus according to claim 1, wherein said speed control means drives the electric motor based on a car speed command and a pressure balance command for rotating the electric motor at a low sped such that the pressure in the hydraulic pump on the ejection side becomes equal to the pressure in the hydraulic jack system.

3. An apparatus according to claim 2, wherein said feedback means forms the control signal by multiplying, by a compensation factor, the sum of a signal obtained by cutting a DC component of the differential signal and thereafter multiplying the differential signal by a first gain, and another signal obtained by cutting a DC component of the pressure signal and thereafter multiplying the pressure signal by a second gain.

4. An apparatus according to claim 3, wherein said feedback means cuts the DC component of the differential signal by subtracting the pressure balance command from the differential signal and cuts the DC component of the pressure signal by subtracting from the pressure signal the pressure on the ejection side of the hydraulic pump produced when the electric motor is driven by the pressure balance command alone.

* * * * *

UNITED STATES PATENT AND TRADEMARK OFFICE

CERTIFICATE OF CORRECTION

PATENT NO. : 5,243,154

DATED : Sept. 7, 1993

INVENTOR(S) : Tomisawa, et al

It is certified that error appears in the above-indentified patent and that said Letters Patent is hereby corrected as shown below:

Claim 1, column 7, line 20, change "the" to --said--;

Claim 1, column 7, line 28, after "said" insert --control--;

Claim 1, column 7, line 33, change "generating" to --generated--;

Claim 1, column 8, line 5, change "detection" to --detected--.

Claim 2, column 8, line 13, change "sped" to --speed--.

Signed and Sealed this

Fifth Day of April, 1994

Bruce Lehman

*Attest:*

BRUCE LEHMAN

*Attesting Officer*

*Commissioner of Patents and Trademarks*